United States Patent [19]

Schaaf et al.

[11] 4,274,430

[45] Jun. 23, 1981

[54] WALKING CANE APPARATUS

[76] Inventors: Cecil F. Schaaf; Craig R. Schaaf, both of 3015 Palmer Rd., Standish, Mich. 48658

[21] Appl. No.: 66,531

[22] Filed: Aug. 15, 1979

[51] Int. Cl.[3] ..... A61H 3/00

[52] U.S. Cl. ..... 135/65; 135/74

[58] Field of Search ..... 135/65–67, 135/74

[56] References Cited

U.S. PATENT DOCUMENTS

| | | | |
|---|---|---|---|
| 1,729,557 | 9/1929 | Stoll | 135/67 X |
| 2,642,074 | 6/1953 | Pedley et al. | 135/65 |
| 2,782,796 | 2/1957 | Blue | 135/65 |
| 3,223,099 | 12/1965 | Hagood | 135/66 X |
| 3,273,575 | 9/1966 | Aldrich . | |
| 3,289,685 | 12/1966 | Parker | 135/65 |
| 3,738,674 | 6/1973 | Pauls | 135/66 X |
| 3,999,565 | 12/1976 | Delacour et al. | 135/65 |
| 4,091,828 | 5/1978 | Jorgensen | 135/66 |

FOREIGN PATENT DOCUMENTS

| | | | |
|---|---|---|---|
| 1016156 | 11/1952 | France | 135/66 |
| 2267750 | 11/1975 | France | 135/67 |
| 2020967 | 11/1979 | United Kingdom | 135/66 |

*Primary Examiner*—J. Karl Bell

*Attorney, Agent, or Firm*—Leydig, Voit, Osann, Mayer & Holt, Ltd.

[57] ABSTRACT

A cane apparatus adaptable for use as an ordinary walking cane and also having the capability of assisting a person in walking on stairs. A support structure having a foot support platform is releasably mounted adjacent the lower portion of the cane to assist a person in walking up and down steps which might otherwise be too high. The height of the foot-bearing platform surface is designed to be about one-half the height of an average step to reduce the maximum necessary vertical distance between the feet of a person walking on steps to approximately one-half of what it would otherwise be. When the platform is in its lowered position for walking on stairs, the cane shaft is free for limited rotation from the vertical in all directions.

7 Claims, 7 Drawing Figures

WALKING CANE APPARATUS

DESCRIPTION OF THE INVENTION

This invention relates to walking aides and more particularly to a walking cane apparatus for assisting a person in walking on stairs as well as on level surfaces.

Many people through age or infirmity have difficulty in walking and yet perambulate satisfactorily through the use of a walking stick or cane. A further difficulty, however, is often encountered by such a person when called upon to ascend or descend a flight of stairs. Such a person might also have difficulty ascending or descending single steps or curbs.

Persons having difficulty walking may find it impossible to raise their legs sufficiently in walking to clear a step or a curb, or they may find that they lack sufficient strength to raise themselves the entire height of a single step or curb with the strength of one leg. An ordinary cane or walking stick carried by a person encountering curbs and stairs is of no real assistance in most cases and, in fact, becomes merely another burden in such a situation. In case no assistance is available, a person unable to climb or descend a flight of stairs, for example, may even have to resort to crawling in order to traverse the stairs.

It is therefore an object of the present invention to provide a walking cane apparatus which is additionally useful in assisting a person to ascend and descend stairs and curbs and the like.

It is a further object of the present invention to provide such a walking cane apparatus wherein the stair-walking aid structure may be conveniently maintained in a storage position until needed and then conveniently released to an operable position for walking on stairs.

It is a related object of the present invention to provide such a walking cane apparatus which permits some limited freedom of motion between the walking cane and the support structure to enhance balance and durability of the apparatus.

Other objects and advantages of the invention will become apparent upon reading the following detailed description and upon reference to the drawings in which.

Figure 1:
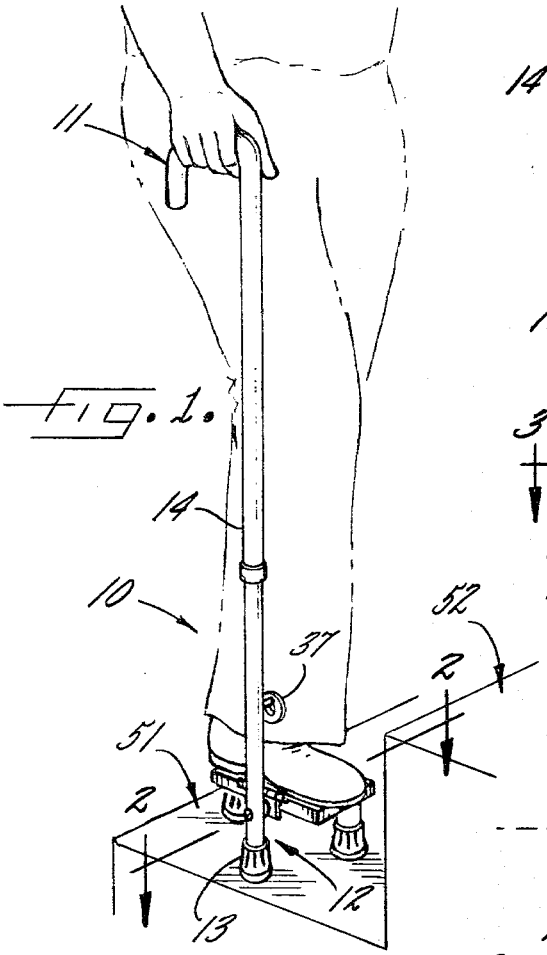
FIG. 1 is a perspective view of the walking cane apparatus with the stair-walking aid portion thereof shown in an operable position and in use by a person on stairs.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention, as defined by the appended claims.

Figure 2:
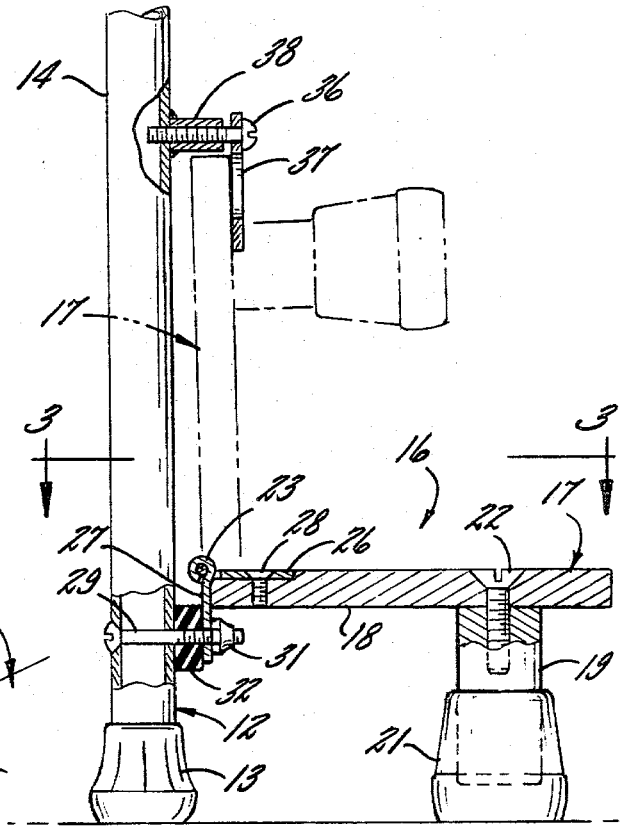
FIG. 2 is a cross sectional view of the lower portion of the walking cane apparatus of FIG. 1 taken along the lines 2—2.
Figure 3:
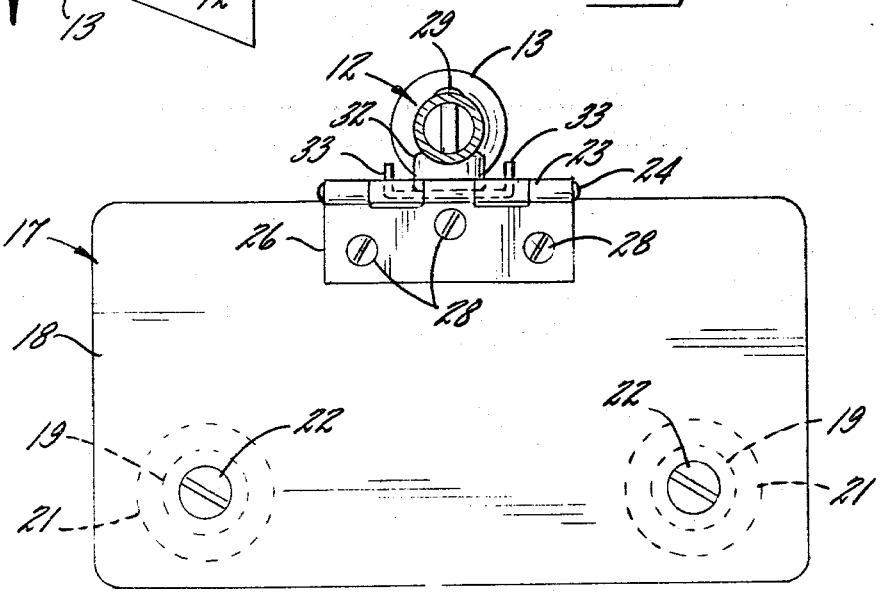
FIG. 3 is a top view of the stair-walking aid portion of the walking cane apparatus taken along the line 3—3 of FIG. 2 and in the direction of the arrows.

Referring first to FIGS. 1, 2 and 3, there is illustrated a walking cane apparatus 10 including a walking cane portion 14 and a stair-walking aid portion 16. The walking cane portion 14 of the apparatus is a conventional walking cane having an upper handle portion 11 and a lower portion 12 including a ground engaging tip member 13 affixed to the lower end 12 of the cane portion and constructed of a durable resilient material such as rubber. The walking cane portion 14 of the walking cane apparatus 10 may comprise any one of a number of walking canes such as those of adjustable height, or with different handle portion 11 configurations, different shapes and so on.

In accordance with the invention, there is attached to the walking cane portion 14 a support structure generally indicated at 16 to serve as a stair-walking aid. The support structure 16 includes a platform 18 which is pivotally attached to the cane portion 14 and supported in addition by a pair of support legs 19. With the support portion 16 in its operative position to serve as a stair-walking aid, the solid line position of FIG. 2, the platform 18 presents an upwardly facing support surface 17 upon which a person using the apparatus places one foot in order to facilitate walking on stairs.

To use the walking cane apparatus 10 as a stair-walking aid, with the platform 18 in its lowered position as shown in FIGS. 1 and 2, a person holds the cane 14 generally vertically and places one foot on the platform surface 17. As shown in FIG. 1, a person using the apparatus places his right foot on the platform surface 17 with his left foot resting on the surface of step S1. In order to reach the step S2, he would then shift his weight from his left foot resting on S1 to his right foot resting on the platform surface 17, gradually raising himself to the level of the platform surface 17 above the step S1. Then he would continue to raise his left foot on to the step S2 and step up onto S2 with his left foot. He would then lift his right foot and the walking cane apparatus up to the step S2. The person using the apparatus 10, in raising his right foot up to the step S2, may leave his right foot resting on the platform surface 17 and raise his right foot and the walking cane apparatus up to the step S2 so that his right foot would immediately be positioned to support his weight for stepping up to the next step.

The height of the platform surface 17 above the surface upon which the walking cane apparatus 10 is resting, is preferably about one half of the height of an average step. Then, the maximum distance separating the feet of a person using the apparatus is usually about one half the height of the step.

The foot-bearing platform 18 of the walking cane apparatus is supported along one edge by a hinged attachment to the cane 14 and near the opposite edge by a pair of feet 19. Each foot 19 is received in a resilient foot member 21 similar to the cane tip member 13. Each foot 19 is attached to the platform 18 by a screw 22.

The platform 18 is supported along its edge adjacent to the cane 14 in a manner which permits at least a limited degree of freedom of motion in three orthogonal directions or planes by a hinge 23 which is attached to the lower end 12 of the cane 14 as shall be described hereinafter. The hinge 23 has a hinge plate 26 attached to the top of the platform 18 by screws 28. The hinge plate 26, and hence the platform 18, is rotatable about a hinge pin 24 relative to the other hinge plate 27 of the hinge 23. Rotation of the platform 18 about the hinge pin 24 permits the rotation of the support portion 16 from its solid line position in FIG. 2 to the dashed line position with the platform 18 substantially vertical adjacent the cane 14.

In order to provide further freedom of motion of the platform 18 relative to the cane 14, the second hinge plate 27 of the hinge 23 is not directly attached to the lower end 12 of the cane but is pivotally attached for unlimited motion in two further planes. The hinge plate 27 is pivotally attached to the lower end 12 the portion 14 by a nut and bolt 31 and 29. Interposed between the hinge plate 27 and the lower end 12 of the cane 14 is a piece of rubber or other resilient material 32, the function of which is to be discussed hereinafter. The bolt 29 passes through an aperture in the hinge plate 27 which is sized to permit rotation of the hinge plate 27 about the bolt shaft 29. In order to limit the amount of possible rotation about the axis of the shaft of the bolt 29, the hinge plate 27 includes a pair of flanged end portions 33 extending toward and on either side of the cane 14. The flanges 33 are not in contact with the cane 14 when the cane is in a substantially vertical orientation as shown in FIG. 3. However, if the platform 18 and hinge 23 are rotated about the axis of the shaft of the bolt 29, the edges of the flanges 33 nearest the cane 14 will engage the cane and thereby prevent further rotation of the hinge and platform relative to the cane.

The freedom of rotation of the cane 14 relative to the platform 18 allows for some side-to-side and front-to-back forces to be applied to the cane without the stress from these forces at the hinge joint structure between the platform and the cane being broken or damaged. A small amount of rotation of the cane 14 about its own elongated axis is also possible since the aperture in the hinge plage 27 is sized slightly larger than the shaft of the bolt 29. This rotation, however, is limited by the small amount of play between the bolt shaft and the aperture and by compression forces of the rubber piece 32.

In accordance with another aspect of the invention, means are provided for easily converting the platform portion 16 between its operational and storage positions with the use of only one hand. This ease of conversion is desirable since often persons using the walking cane apparatus 10 will need to use one hand for balance while placing the platform in either its operational or storage location.

Figure 4:
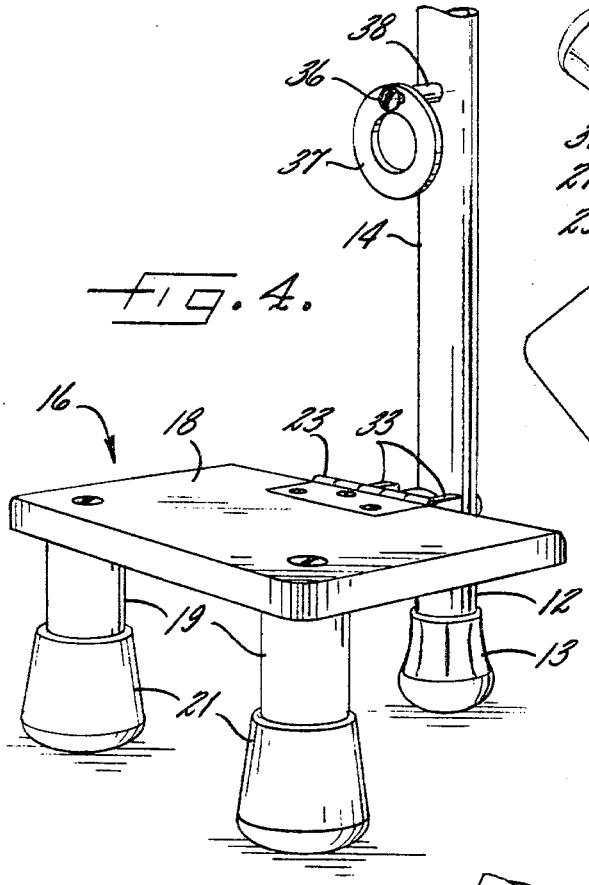
FIG. 4 is a perspective view of the lower portion of the walking cane apparatus with the stair-walking aid portion in its lowered, operative position.

Turning to the sequence of FIGS. 4 through 7, in FIG. 4 the platform 18 is shown in its substantially horizontal operative position for assisting a person in walking on stairs. In order to be able to maintain the platform 18 in a storage, nonoperational, position, a latching means is provided. The latching means comprises a bolt 36 received and affixed within a projection 38 on the side of the cane 14 and a circular latching member 37 eccentrically mounted on the shaft of the bolt 36. An aperture in the latching member 37 receives a portion of the shaft of the bolt 36 extending beyond the projection 38 and the latching member 37 is free to rotate about the bolt shaft.

Figure 5:
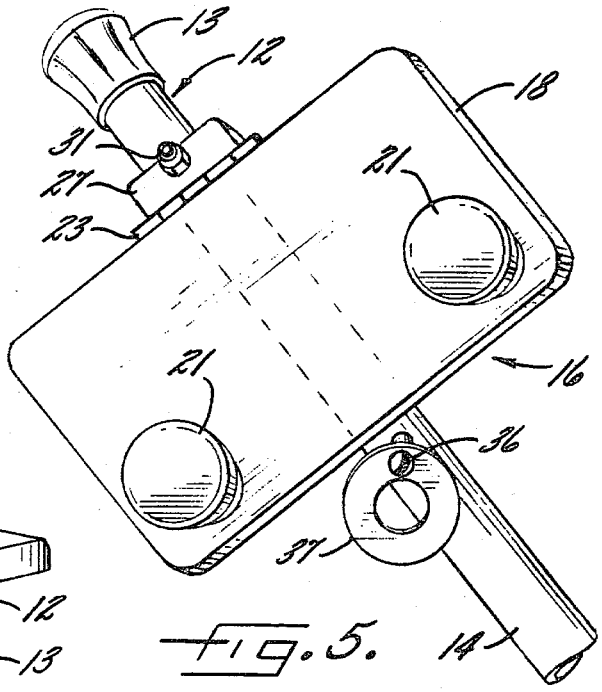
FIG. 5 is a perspective view of the lower portion of the walking cane apparatus in a raised position wherein the stair-walking aid portion is in its nonoperative position.
Figure 6:
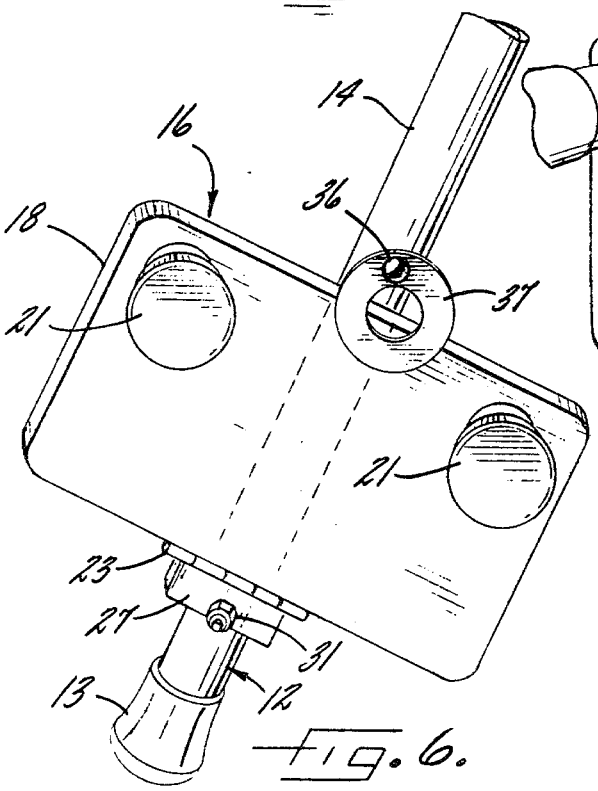
FIG. 6 is a perspective view of the lower portion of the walking cane apparatus in a lowered position with the stair-walking aid portion latched in its nonoperative position.
Figure 7:
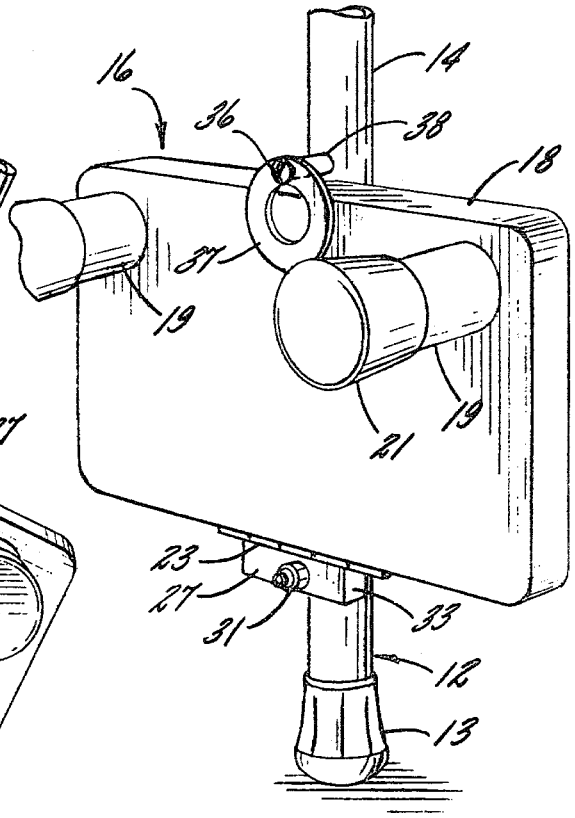
FIG. 7 is a perspective view of the lower portion of the walking cane apparatus returned to a vertical position similar to that of FIG. 4 except that the stair-walking aid portion is latched in its nonoperative position.

In order to latch the platform portion 16 of the cane apparatus 10 in its nonoperative, or storage position, as shown in FIG. 7, the lower end 12 of the cane 14 is raised above the handle portion by the user of the cane apparatus. Then, as shown in FIG. 5, with the cane apparatus raised, the cane 14 is tipped rearwardly so that the platform 18 swings adjacent the cane 14 about the hinge 23. Next, the lower end 12 of the cane 14 is lowered while the platform 18 is maintained adjacent the cane portion. As this is done, as shown in FIG. 6, the latching member 37 rotates about the shaft of the bolt 36, and due to its eccentric attachment, the latching member 37 rotates to a position where it overlays the underside of the platform 18. As shown in FIG. 7, when the walking cane apparatus 10 is returned to a substantially vertical position, the latching member 37 maintains the platform 18 adjacent the cane 14.

In order to place the walking cane apparatus 10 in the stair-walking aid configuration of FIG. 4, from the storage position shown in FIG. 7, the steps are reversed. The cane apparatus is lifted from its position shown in FIG. 7 through that shown in FIG. 6 to the position shown in FIG. 5. Then the apparatus is tipped forwardly so that the platform 18 swings away from the cane 14 about the hinge 23, and then the lower end 12 of the cane is lowered to the ground, with the platform 18 swing outwardly to its operational position.

It can be seen that when the walking cane apparatus is in its walking cane configuration, with the platform 18 stored adjacent the cane 14, the cane apparatus may be used as a traditional walking cane. When a step or curb or set of stairs is encountered, the cane apparatus 10 may be placed in the configuration shown in FIGS. 1 and 4 by the method described above, in order to provide assistance in ascending or descending the curb or steps.

It can be seen therefore that a walking cane apparatus has been described which is useful in assisting a person to ascend and descend stairs and curbs and the like. It can be further seen that such a walking cane apparatus has been described wherein the stair-walking aid structure of the apparatus may be conveniently maintained in a storage position until needed and then conveniently released to an operable position for walking on stairs.

What is claimed is:

1. A walking cane apparatus for assisting a person in walking on generally level surfaces and also on stairs and the like comprising:

a cane having a lower end operable to contact a walking surface and having an upper end portion operable to be grasped by a person using the cane apparatus;

a support structure including a platform surface which is operable to receive and support a foot of a person using the cane apparatus when the platform surface is in a first, generally upwardly facing position; and means for attaching the support structure to the cane near its lower end to permit placing the platform surface in its first position and in a second position generally nearer the cane than the first position.

2. The cane apparatus of claim 1 in which the support structure comprises a platform member including the platform surface and two support legs attached to the platform member and extending downwardly into contact with a walking surface when the platform surface is in its first position.

3. The cane apparatus of claim 2 in which the means for attaching comprises a hinge having a first hinge plate attached to the platform member and a second hinge plate attached to the cane.

4. The cane apparatus of claim 3 in which the platform member has an edge nearest the cane when the platform surface is in its first position, the hinge being attached adjacent said edge of the platform member, whereby the platform member may be rotated towards the cane to rotate the platform surface from its first position to the second position.

5. The cane apparatus of claim 4 in which the second hinge plate is pivotally attached to the cane for rotation about an axis which is generally parallel to a level walking surface and in which the cane apparatus further comprises means for limiting the amount of pivotal motion of the second hinge plate relative to the cane.

6. An elongated walking cane apparatus for assisting a person in walking on generally level surfaces and also on stairs and the like comprising:

a cane having an elongated shaft, having a lower end operable to contact a walking surface, and having an upper end portion operable to be grasped by a person using the cane apparatus;

a support platform having a first surface which is operable to receive and support a foot of a person using the cane apparatus when the first surface is in a first, generally upwardly facing, position, the platform member having a first edge portion proximal to the cane when the first platform surface is in its first position and having a second edge portion which is distal from the cane when the first platform surface is in its first position;

support means for the support platform for maintaining the first platform surface in the first position; and means for pivotally attaching the support platform adjacent its proximal edge to the cane near the cane's lower end so as to permit swinging the platform member upwardly, moving the first platform surface from its first position to a second position adjacent the cane; and means for releasably latching the distal edge of the platform member to maintain the first platform surface in its second position.

7. The cane apparatus of claim 6 in which the means for latching comprises a latch piece eccentrically mounted for at least partial rotation about a pin member attached to the cane, the latch piece being spaced apart from the cane a distance greater than the thickness of the distal edge portion of the platform member, whereby inverting the cane causes rotation of the latch piece to a position which permits swinging of the platform member and return of the cane to its original orientation causes the latch piece to rotate to a position where the platform member cannot be swung between the second position of the first platform surface and its first position.

* * * * *